US008100452B1

(12) United States Patent
Homewood

(10) Patent No.: US 8,100,452 B1
(45) Date of Patent: Jan. 24, 2012

(54) SCOOP FOR BAGGING SAND

(76) Inventor: Stephan K. Homewood, Gainesville, FL (US)

( * ) Notice: Subject to any disclaimer, the term of this patent is extended or adjusted under 35 U.S.C. 154(b) by 0 days.

(21) Appl. No.: 11/057,249

(22) Filed: Feb. 15, 2005

Related U.S. Application Data

(60) Provisional application No. 60/545,227, filed on Feb. 17, 2004.

(51) Int. Cl.
*A01B 1/00* (2006.01)
*B65B 67/00* (2006.01)

(52) U.S. Cl. ..... 294/178; 294/214; 141/391

(58) Field of Classification Search ..... 294/1.1, 294/55, 1.3–1.5; 141/390, 391, 108, 109; 15/257.3; 172/377
See application file for complete search history.

(56) References Cited

U.S. PATENT DOCUMENTS

| | | | | | |
|---|---|---|---|---|---|
| 112,727 | A | | 3/1871 | Lum | |
| 121,529 | A | * | 12/1871 | Lum | 141/84 |
| 571,513 | A | | 11/1896 | Davidson | |
| 741,195 | A | * | 10/1903 | Voelker | 294/55 |
| 1,167,782 | A | * | 1/1916 | Richards | 141/108 |
| 1,182,412 | A | | 5/1916 | Olesberg | |
| 1,212,305 | A | * | 1/1917 | Worsell | 294/55 |
| 1,234,057 | A | * | 7/1917 | McIntyre | 141/314 |
| 1,796,288 | A | * | 3/1931 | Hester | 141/314 |
| 2,812,784 | A | * | 11/1957 | Palmer | 141/98 |
| 3,063,174 | A | * | 11/1962 | Ludin | 37/434 |
| 3,255,570 | A | | 6/1966 | Weimer | |
| 4,126,346 | A | | 11/1978 | Burns | |
| 4,149,745 | A | * | 4/1979 | Willis | 294/1.4 |
| 4,312,531 | A | | 1/1982 | Cross | |
| 4,697,835 | A | * | 10/1987 | Scott | 294/55 |
| 5,031,948 | A | * | 7/1991 | Groth et al. | 294/1.1 |
| 5,107,666 | A | * | 4/1992 | Rahtican | 56/202 |
| 5,395,147 | A | * | 3/1995 | Brown et al. | 294/55 |
| 5,655,739 | A | * | 8/1997 | Teh-Wah Goo | 248/101 |
| 5,687,781 | A | * | 11/1997 | Grizz | 141/316 |
| 5,845,685 | A | | 12/1998 | Cooper | |
| 5,868,447 | A | * | 2/1999 | Clark et al. | 294/1.4 |
| 5,897,084 | A | * | 4/1999 | Judge | 248/95 |
| 5,951,079 | A | | 9/1999 | Winskye | |
| 6,378,577 | B1 | | 4/2002 | Piner et al. | |
| 6,643,892 | B1 | | 11/2003 | Murphy | |
| 6,708,742 | B2 | | 3/2004 | Weathers et al. | |
| D514,268 | S | * | 1/2006 | Schuster | D34/1 |
| 2003/0201650 | A1 | * | 10/2003 | Springs, II | 294/5.5 |

* cited by examiner

*Primary Examiner* — Dean Kramer
(74) *Attorney, Agent, or Firm* — Donald W. Marks

(57) ABSTRACT

A scoop for filling bags has a channel shaped member open at its forward and rear ends with an open top extending through forward and rear portions between the forward and rear ends. The forward portion has a flat bottom with two sides tapering inward from the front to the rear portion. The rear portion transitions from the flat bottom and the two sides of the forward portion to an open-top arcuate cross-section at the rear end suitable for being inserted into an open end of a bag. Forward and rear handles extend across the open top at the respective forward and rear portions with ends fastened to the two sides.

2 Claims, 2 Drawing Sheets

SCOOP FOR BAGGING SAND

CROSS-REFERENCE TO RELATED APPLICATION

This application claims priority under 35 U.S.C. §119(e) of U.S. Provisional Patent Application 60/545,227 filed Feb. 17, 2004 and which is expressly incorporated herein in its entirely by reference.

BACKGROUND OF THE INVENTION

The present invention relates to devices for filling bags with granular material such as scoops for filling polymer fabric bags with sand for use as dikes or barriers to flood water.

The prior art contains many scoop devices for filling bags with sand or other granular material. These prior art devices generally suffer from one or more deficiencies such as being awkward or inconvenient to use, expensive. etc. Thus sand bag filling is often performed by one person holding a bag open and a second person using an ordinary shovel or spade to scoop sand from a pile and drop the sand into the open top of the bag. In another prior art procedure enabling a single person to fill a bag, a PVC tube is inserted in the bag to hold the bag open and upright so that the person can shovel sand into the bag until it is full after which the tube is removed and the bag closed.

BRIEF SUMMARY OF THE INVENTION

The invention is summarized in a scoop for filling bags formed by a channel shaped member open at its forward and rear ends and having an open top extending through forward and rear portions between the forward and rear ends. The forward portion has a flat bottom with two sides tapering toward each other from the front to the rear portion. The rear portion transitions from the flat bottom and the two sides of the forward portion to an open-top arcuate cross-section at the rear end suitable for being inserted into an open end of a bag. Forward and rear handles extend transversely across the open top at the respective forward and rear portions with ends fastened to the two sides.

In one specific embodiment, the channel member is formed of sheet metal with reinforcing ribs embossed in the flat bottom and flat sides.

In an additional feature an elongated cylindrical member is secured on the outside of the forward arcuate portion perpendicular to the channel member for assisting in retaining the bag on the arcuate portion.

Still further, transverse slots are formed in the flat bottom for receiving the tip of a trenching tool suitable to provide a support for the scoop and to enable use of the scoop as a free-standing funnel member to fill bags.

Additionally cutouts in the sheet metal at the forward portion form hooks for fastening the top of the bag to the scoop.

Other features, advantages and objects of the invention will be apparent from the following detailed description and the accompanying drawings.

DETAILED DESCRIPTION OF THE INVENTION

Figure 1:
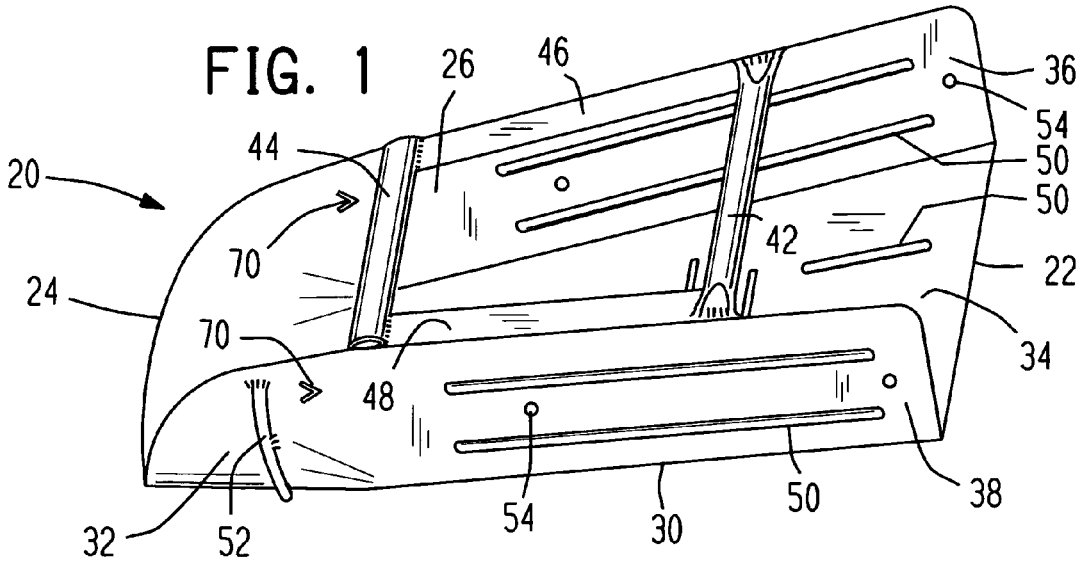
FIG. 1 is a perspective view of a scoop for filling bags in accordance with the invention.
Figure 2:
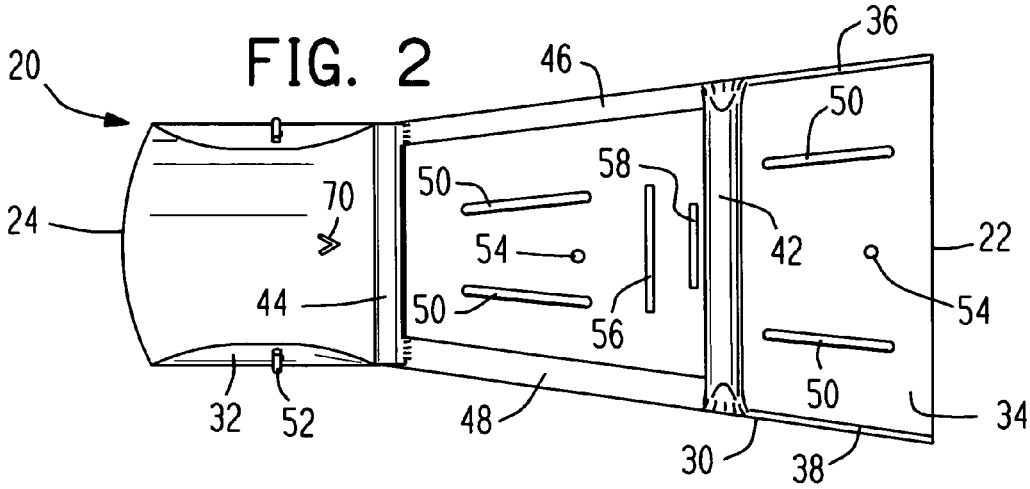
FIG. 2 is a top view of the scoop of FIG. 1.
Figure 3:
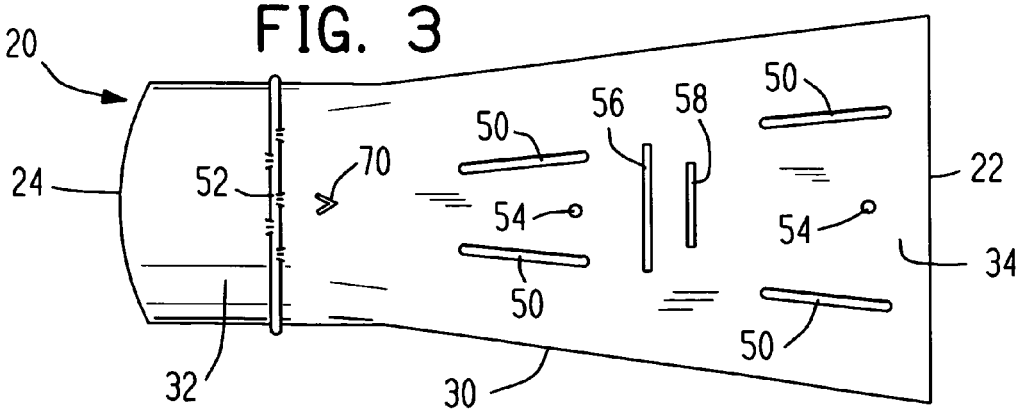
FIG. 3 is a bottom view of the scoop of FIG. 1
Figure 4:
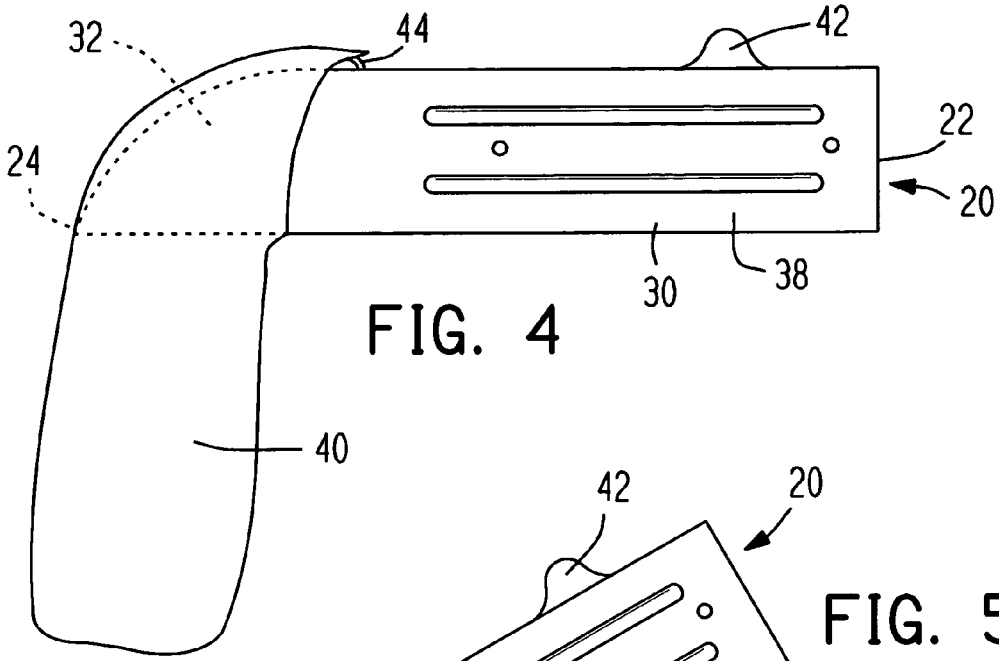
FIG. 4 is an elevation view of the scoop of FIG. 1 with a rear end inserted into an open end of a bag.

As shown in FIGS. 1, 2 and 3, a scoop for filling bags in accordance with the invention has a channel member indicated generally at 20 open at its forward and rear ends 22 and 24 with an open top 26 extending the entire length of the member 20 through forward and rear portions 30 and 32 between the forward and rear ends. The forward portion 30 has a flat bottom 34 and two vertical sides 36 and 38. These sides 36 and 38 taper inward from the front end 22 to the beginning of the rear portion 32. The forward end of the rear portion 32 transitions from the flat bottom and the two sides of the forward portion to an open-top arcuate cross-section at the rear end 24 suitable for being inserted into an open end of a bag 40, see FIGS. 4 and 5. A forward handle 42 extends transversely across the open top at the forward portion 30 and has ends fastened to the tops of the two sides 36 and 38. A rear handle 44 extends transversely across the open top at the rear portion 32 and has ends fastened to the tops of the two sides 36 and 38 where the sides transition into the arcuate cross section.

In a bag filling operation, a user lifts the scoop with one hand gripping the forward handle 42. With the other hand the user pulls the open end of a bag 40 on the rear portion 32 to the rear handle 44. The rear handle 44 is gripped by the user's other hand with a top edge portion of the bag being partially wrapped around the rear handle 44 and held by the user's other hand. The user thrusts the forward end 22 of the scoop into a mound or pile of sand to fill the forward portion 30 of the scoop with sand. Then the forward end 22 of the scoop is raised to funnel the sand through the rear end 24 into the bag held on the rear portion 32.

This thrusting of the scoop into the sand and tilting of the forward end upward can be performed in one continuous motion by the user. The shape of the intake of the scoop being a rectangle with an open top is particularly efficient in loading a relatively large volume of sand into the scoop. This volume of sand is readily funneled through the decreasing width between the sides 36 and 38 and through the arcuate forward portion which extends into the bag. The particular structure of the bag filling device provides for easy and rapid placement of a bag on the exit end of the filling device and immediate scooping and funneling of sand without any change in hand positions gripping the device.

After the bag has been filled, release of the hand gripping the rear handle 44 releases the bag. The bag either falls from scoop or the scoop is raised from the bag leaving the bag in an upright position whereupon the open top of the bag can be tied shut or otherwise closed.

Preferably the channel member 20 is sized to fill the bag with one scoop operation to enable rapid filling of a many bags. For example, it has been demonstrated that a single person can fill up to about five bags during the time that it takes for two people, one person holding the bag and the second person shoveling sand in the bag, or a single person placing a PVC tube in a bag and shoveling sand in the bag to complete the operation of filling one bag. With a smaller channel member or a larger bag, the bag can be filled with two or more scoop operations at a slower rate but still faster than the above mentioned prior art procedure of two people or a single person filling a bag.

The channel member 20 in one embodiment is formed of sheet metal, such as 22-gauge sheet steel, that has been bent in the forward portion 30 to form the two flat sides 36 and 38 extending vertically upward at right angles) (90° to the bottom 34. The top edges of the sides 36 and 38 in a central portion of the channel member 20 are bent inward to form flanges 46 and 48 to provide additional strength to the channel member 20 as well as additional support for the handles 42 and 44 which can be welded to the flanges 46 and 48 as well as to the top edges of the sides 36 and 38. Reinforcing ribs 50 are embossed in the bottom 34 and sides 36 and 38 to provide further strength and resistance against bending. In other embodiments the channel member 20 can be formed from materials other that sheet steel such as plastic, aluminum, etc.

A rib member such as cylindrical member 52, for example a one-fourth inch diameter wire, extends around the outside of the rear arcuate portion 32 in a vertical plane perpendicular to the longitudinal dimension of the channel member 20. The cylindrical member 52 is shown fastened to the rear arcuate portion by welding. In use as a scoop, the user when gripping the rear handle 44 also grips the top edge of the bag 40 causing the fabric of the bag to be tightly drawn to the outside of the arcuate rear portion 32 to deform the bag fabric around the rib member 52 and assist in preventing the bag from slipping off the rear portion 32 during a filling operation. Additionally the rounded surface of the rib member 52 allows the fabric of the bag to easily slide on and off of the rear portion 32 when not gripped to the handle 44 to facilitate speedy placement and removal of bags. Furthermore the rib member 32 strengthens the forward portion 32. As an alternative to the wire or cylindrical member, the rib member 52 could be formed by embossing the sheet metal.

In one embodiment, the channel member 20 is about two feet in length with a forward portion 30 of about fourteen inches in the elongated dimension of the scoop and a rear portion 32 of about ten inches in the elongated dimension of the scoop. The width between the side walls 36 and 38 at the forward end 22 is about one foot which narrows to about seven inches at the forward end of the rear portion 32. In the rear portion 32 the arcuate dimension (circular or oval) has a diameter of about seven inches throughout the length of the rear portion. The side walls 36 and 38 of channel member 20 are about six inches high. This height is continued in the top edges of the arcuate portion 32 adjacent to the forward portion 30 but decreases exponentially toward the rear end 24 so as to form rounded top edges at the rear end. This size is suitable for filling bags about one foot wide and two feet in length and can be used be used to fill many other sizes of bags such as commercially available sand bags of eighteen by thirty inches, fourteen by twenty-five inches, twelve by twenty-five inches or thirteen by twenty-four inches.

The handles 42 and 44 are formed of thin walled steel tubes of different diameters in one embodiment. The forward handle 42 has a diameter of about three-fourths inch while the rear handle 44 has a diameter of about one-half inch. The larger diameter of the forward handle provides reduction in fatigue during continuous use while the smaller diameter of the rear handle facilitates wrapping and gripping of the top edge of a bag to the rear handle. Other embodiments can form handles of different materials and sizes and/or which can be fastened to the channel member 20 by facilities different from welding to extend transversely over the open top of the channel member 20.

Figure 5:
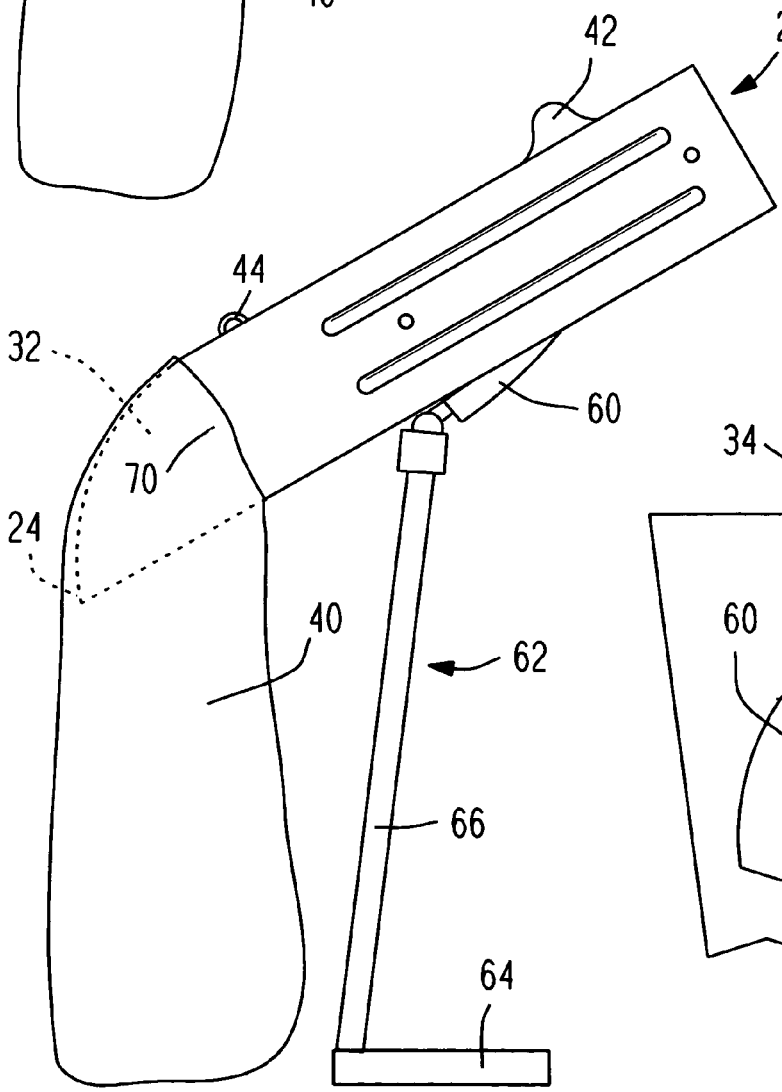
FIG. 5 is a elevation view of the scoop of FIG. 1 mounted on a support for enabling the scoop to be used as a funnel member for filling bags.
Figure 6:
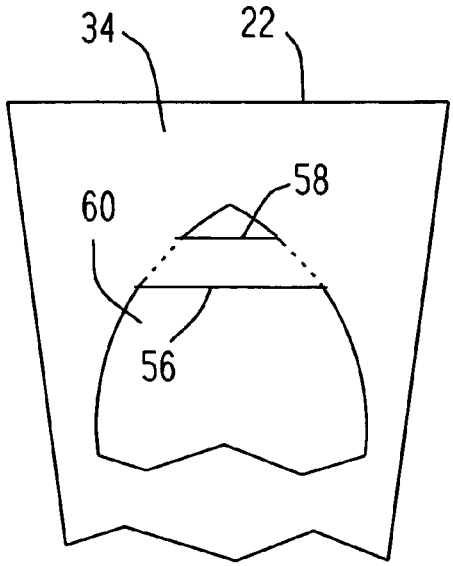
FIG. 6 is a bottom view of cut away portions of the scoop and support of FIG. 5.

The scoop in one embodiment also includes facilities for enabling mounting on a support and use of the scoop as a funnel. Such facilities include one or more holes 54 formed in the bottom 34 and/or sides 36 and 38 and/or a long transverse slot 56 and short transverse slot 58 formed in the bottom 34. Holes 54 allow a scoop to be fastened by screws, bolts or nails to a support such as a post, board or frame so that the scoop is freestanding and can be used as a funnel to fill bags. As shown in FIGS. 5 and 6, the slots 56 and 58 in the bottom 34 are formed to receive the tip of a blade 60 of a trenching tool 62 which can be used to provide a support for the scoop so that the scoop can be used as a funnel for filing bags. The blade 60 or the trenching tool 62 can be set an angle providing the desired incline for funneling sand into a bag 40. A hand grip 64 on the end of the handle 66 opposite the blade 60 can be set an angle and has a size sufficient to provide a base support for the trenching tool 62 and funneling device.

Cutouts or knockouts 70 are formed in the rear portion 32 so as to form V-shaped hooks which can be used to fasten the top of the bag 40 to the scoop when the scoop is used as a free standing funnel to fill bags as illustrated in FIG. 5.

The bag filling device of the invention is readily adaptable to various configurations and uses. Two or more of the devices can be bolted together or mounted on a frame or support to enable plural users to simultaneously fill two or more bags or to allow use of a front-end loader or other equipment to fill many bags at once. Further plural devices could be mounted at the rear of a truck bed to allow simultaneous filling of plural bags directly form sand carried by the truck. In another possible use, plural bag filling devices could be mounted on a chassis on the rear of a tractor enabling the forward ends of the devices to engage soil or sand and simultaneously fill plural bags Since the bag filling device or scoop in accordance with the invention can have many embodiments, variations or modifications, it is intended that the forgoing detailed description be interpreted as only illustrative and not in a limiting sense.

The invention claimed is:

1. A scoop for filling bags comprising:

a channel shaped member formed of sheet metal open at its forward and rear ends and having an open top extending through forward and rear portions between the forward and rear ends;

said forward portion having a flat bottom with two upward extending flat sides tapering inward from the front to the rear portion wherein the two sides in the forward portion are flat vertical panels extending at right angles to the flat bottom and the flat bottom and the flat sides have longitudinal reinforcing ribs embossed therein;

said rear portion transitioning from the flat bottom and the two sides of the forward portion to an arcuate cross section at the rear end suitable for being inserted in an open end of a bag;

a forward handle extending across the open top at the forward portion and having ends fastened to the two sides;

a rear handle extending across the open top at the rear portion and having ends fastened to the two sides where the sides transition into tops of the arcuate cross section; and means for attaching the scoop to a support so as to form a stationary funnel-like device to fill bags;

said attaching means including a pair of transverse slots in the flat bottom for receiving a tip of a trenching tool having an adjustable handle which can be set to provide the support.

2. A scoop as claimed in claim 1 wherein the rear portion has hooks formed therein by V-shaped cutouts to secure a bag on the rear portion.

* * * * *